US005605258A

United States Patent [19]

Abplanalp

[11] Patent Number: 5,605,258

[45] **Date of Patent: *Feb. 25, 1997**

[54] IMPROVED TWO-PIECE AEROSOL VALVE FOR VERTICAL OR TILT ACTION

[76] Inventor: Robert H. Abplanalp, 10 Hewitt Ave., Bronxville, N.Y. 10708

[ * ] Notice: The portion of the term of this patent subsequent to Jul. 2, 2008, has been disclaimed.

[21] Appl. No.: 599,121

[22] Filed: Feb. 9, 1996

Related U.S. Application Data

[63] Continuation of Ser. No. 493,001, Jun. 21, 1995, abandoned, which is a continuation of Ser. No. 329,675, Oct. 26, 1994, abandoned, which is a continuation of Ser. No. 206,198, Mar. 2, 1994, abandoned, which is a continuation of Ser. No. 87,467, Jul. 6, 1993, abandoned, which is a continuation of Ser. No. 724,657, Jul. 2, 1991, abandoned, which is a continuation-in-part of Ser. No. 385,981, Jul. 24, 1989, Pat. No. 5,027,985, which is a continuation of Ser. No. 275,654, Nov. 21, 1988, abandoned, which is a continuation of Ser. No. 159,468, Feb. 19, 1988, abandoned, which is a continuation of Ser. No. 934,817, Dec. 3, 1986, abandoned.

[51] Int. Cl.[6] ..... B65D 83/00

[52] U.S. Cl. ..... 222/402.1; 222/402.22; 239/337

[58] Field of Search ..... 222/402.1, 402.21, 222/402.22, 402.23, 402.24; 251/353; 239/337

[56] References Cited

U.S. PATENT DOCUMENTS

| | | | |
|---|---|---|---|
| 2,581,262 | 1/1952 | Loven et al. . | |
| 2,806,739 | 9/1957 | Drell . | |
| 2,881,808 | 4/1959 | Germain . | |
| 2,913,154 | 11/1959 | Kuffer . | |
| 3,045,877 | 7/1962 | Green . | |
| 3,053,459 | 9/1962 | Corsette . | |
| 3,098,589 | 7/1963 | Graham . | |
| 3,166,250 | 1/1965 | Kappel | 239/337 |
| 3,404,863 | 10/1968 | Green | 251/353 X |
| 3,506,165 | 4/1970 | Beard . | |
| 3,506,241 | 4/1970 | Ewald . | |
| 3,545,720 | 12/1970 | Ewald . | |
| 3,547,405 | 12/1970 | Ewald | 222/402.22 X |
| 3,583,608 | 6/1971 | Green . | |
| 3,589,571 | 6/1971 | Green | 222/402.24 |
| 3,627,263 | 12/1971 | Warren et al. . | |
| 3,635,379 | 1/1972 | Angele . | |
| 3,658,294 | 4/1972 | Ewald . | |
| 3,674,186 | 7/1972 | Ewald . | |
| 3,731,847 | 5/1973 | Webster | 222/402.21 X |
| 3,735,955 | 5/1973 | Kerr et al. . | |
| 3,785,536 | 1/1974 | Graham . | |
| 3,830,412 | 8/1974 | Green . | |
| 4,019,687 | 4/1977 | Green . | |
| 4,133,461 | 1/1979 | Vercelot | 222/402.24 |
| 4,247,025 | 1/1981 | Gailitis . | |
| 4,275,840 | 6/1981 | Staar . | |
| 4,328,911 | 5/1982 | Knickerbocker . | |
| 4,354,621 | 10/1982 | Knickerbocker . | |
| 4,390,160 | 6/1983 | Reed | 251/353 X |
| 4,393,984 | 7/1983 | Debard . | |
| 4,396,152 | 8/1983 | Abplanalp . | |
| 4,416,398 | 11/1983 | Knickerbocker . | |
| 4,493,444 | 1/1985 | Del Bon et al. . | |
| 4,969,577 | 11/1990 | Werding . | |
| 5,027,985 | 7/1991 | Abplanalp | 251/353 X |
| 5,037,012 | 8/1991 | Langford . | |

FOREIGN PATENT DOCUMENTS

| | | |
|---|---|---|
| 1355082 | 5/1974 | United Kingdom . |

*Primary Examiner*—Gregory L. Huson
*Attorney, Agent, or Firm*—Kilgannon & Steidl

[57] ABSTRACT

In an aerosol valve comprising a mounting cup, a gasket having a central opening, a valve housing, a valve stem and a valve body, where the valve stem and valve body move within the valve housing in response to pressure on the valve stem, the valve body having a cylindrical upstanding wall defining a recess. A slot extending through the wall is defined by the wall and a thin skin. The slot communicates with the interior of the container when the valve is actuated. A swirl chamber may be located at the bottom of the valve body. The valve can be configured for tilt actuation.

29 Claims, 8 Drawing Sheets

IMPROVED TWO-PIECE AEROSOL VALVE FOR VERTICAL OR TILT ACTION

This is a continuation of Ser. No. 08/493,001, filed on Jun. 21, 1995, (now abandoned), which is a continuation of Ser. No. 08/329,675, filed on Oct. 26, 1994, (now abandoned), which is a continuation of Ser. No. 08/206,198, filed on Mar, 2, 1994, (now abandoned), which is a continuation of Ser. No. 08/087,467, filed on Jul. 6, 1993, (now abandoned), which is a continuation of Ser. No. 07/724,657, filed on Jul. 2, 1991, (now abandoned), which is a continuation-in-part of Ser. No. 07/385,981, filed on Jul. 24, 1989, which issued as U.S. Pat. No. 5,027,985, which is a continuation of Ser. No. 07/275,654, filed on Nov. 21, 1988, (now abandoned), which is a continuation of Ser. No. 07/159,468, filed on Feb. 19, 1988, (now abandoned), which is a continuation of Ser. No. 06/934,817, filed on Dec. 3, 1986, (now abandoned).

BACKGROUND OF THE INVENTION

This invention relates to a valve for a pressurized package commonly referred to as an aerosol package.

Aerosol packages usually comprise a valve unit situated in the neck of the container which is opened by finger pressure against an actuator disposed at one terminus of a valve stem. The valve unit has a movable valve body and associated hollow valve stem which unseats from a gasket, thereby permitting flow of product into a hollow valve stem (product conduit).

With certain products, e.g. paints, it is desirable that the valve stem be separable from the valve body in order to clean the product conduit should drying and resultant clogging occur. To provide the aforementioned valve stem removal capability, the valve stem, at one end, is molded integral to the valve actuator to thereby permit its separation from the valve body by pulling on the actuator. At the other end the valve stem mates with a movable valve body situated beneath a resilient gasket, the valve stem being passed through a central opening in the resilient gasket. The gasket seals the product discharge orifice in the valve stem when the valve is in a closed position. By depressing the valve stem, the product orifice in the stem is open to flow of product from the container.

More particularly, the aforedescribed aerosol valve comprises a container closure, commonly called a mounting cup, which is clinched to the container bead. Within and crimped to an upstanding central portion of the mounting cup, commonly called a pedestal, is a valve housing having a resilient gasket disposed atop thereof, which gasket forms a seal between the valve housing and the mounting cup. Disposed within the housing is a reciprocable valve closing/opening member comprising a valve body and valve stem, which body and stem have communicating passages for egress of the pressurized product to a discharge orifice situated in a finger depressible actuator.

The aerosol valve described above is commonly referred to in the aerosol industry as a "female" valve, in contrast to the so called "male" valve wherein the valve stem is molded integral to the valve body. U.S. Pat. Nos. 3,033,473, 3,061,203, 3,074,601 and 3,209,960 describe aerosol valves of the "female" type and U.S. Pat. No. 2,631,814 describes an aerosol valve of the "male" type.

Furthermore, in prior aerosol valves, the product orifice in the valve stem is formed by a radial pin extending laterally through the wall of the valve stem, a so-called "side action" molding operation. The presence of the "side action" pin necessitates the removal of the pin before ejection of the molded part, with a consequent time delay in the molding operation. Moreover, with orifice sizes commonly used in aerosol valves, the "side action" pin often breaks with consequent shutdown of the molding operation.

Additionally, in prior aerosol valves, the central opening of the gasket seals radially against the product orifice in the valve stem. This sealing of the valve stem orifice upon closure of the valve forecloses gravitational return of the product in the hollow valve stem from moving past the valve stem orifice with the often consequent result that residual product in the hollow valve stem drys and clogs the passage in the valve stem.

In U.S. Pat. No. 5,027,985, the parent of the present case which is incorporated by reference herein, a "female" aerosol valve is disclosed having a moveable, gasketed valve body-valve stem located within a valve housing. The valve body has at least one upstanding wall defining a recess in the valve body with a slot extending from the top shoulder of the upstanding wall. The slot provides communication with the interior of the container when the valve is actuated. The valve stem has a longitudinal opening therethrough and a member that frictionally and releasably engages within the valve body recess. The valve stem also has an orifice aligned with the longitudinal opening of the valve stem and which communicates at one end with the slot in the recess of the valve body and at the other end with the orifice in the valve stem. The central opening of the gasket seals the slot defined by the upstanding wall of the valve body when the valve is in a closed position.

It has been found that this configuration is not appropriate for use as a tilt action valve because the stresses inherent in tilt actuation can open the slot in the wall, loosening the valve stem. The valve stem and valve body could then become separated.

The present invention improves upon the design of U.S. Pat. No. 5,027,985 and is also adapted for use as a tilt valve.

SUMMARY OF THE INVENTION

The aerosol valve unit of the present invention comprises a mounting cup, a gasket having a central opening, a valve housing, a valve stem and a valve body, wherein the valve stem and valve body move within the valve housing in response to pressure on the valve stem. The valve body comprises a cylindrical wall defining a recess in the valve body. The cylindrical wall has at least one thin region extending from a top shoulder of the wall, the thin region and the cylindrical wall defining a slot beneath the thin region. The slot communicates with the interior of the container when the valve is actuated.

The valve stem of the present invention comprises an inner cylindrical portion that frictionally and releasably engages within the valve body recess. The valve stem has a longitudinal opening and an orifice aligned with the longitudinal opening of the valve stem. The orifice communicates at one end with the slot in the recess of the valve body and at the other end with the longitudinal opening in the valve stem. The central opening of the gasket seals the slot when the valve is in a closed position.

In another aspect of the present invention, the valve body has a lower portion and the valve body is tapered inwardly toward its lower portion. The valve housing has an upper portion and the valve housing is tapered outward toward the upper portion. The valve body has an annular shoulder portion which engages the gasket when the valve is not actuated, preventing product from passing over the shoulder, closing the valve. The shoulder can be at least partially disengaged from the gasket by vertical or tilt actuation of an actuator button, allowing product to pass over the portion of the shoulder disengaged from the gasket, into the valve body and valve stem for discharge.

In another aspect of the invention, the valve stem further comprises a lower cylindrical portion with a pair of tangential openings, the lower cylindrical portion positioned within the valve body such that product enters the valve stem through these tangential openings, causing the mechanical break up of the product.

DESCRIPTION OF THE INVENTION

Figure 1:
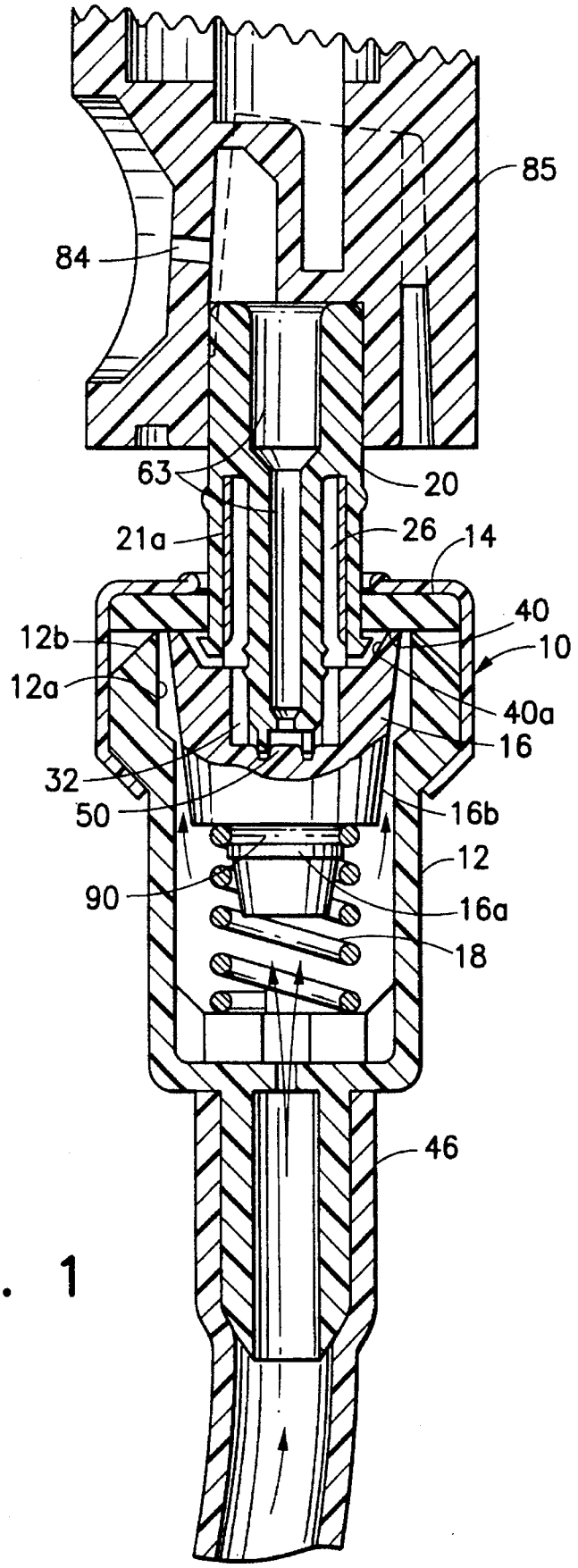
FIG. 1 is a longitudinal sectional view of the valve of the present invention, in its closed position.
Figure 4:
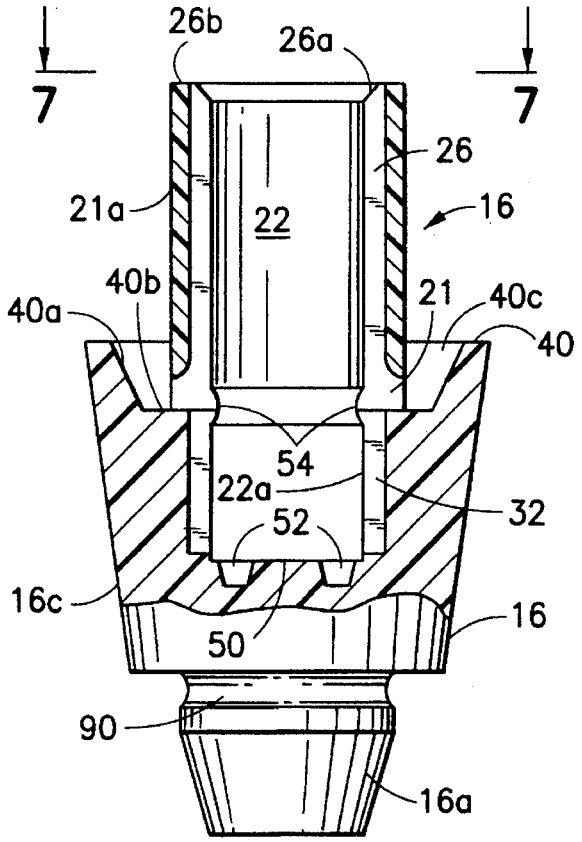
FIG. 4 is a longitudinal partial sectional view of the valve body of the present invention.

FIG. 1 is a longitudinal sectional view of the aerosol valve of the present invention, in a closed position. The mounting cup of the aerosol container, shown partially cut away, is generally designated as 10. Crimped to the mounting cup 10 is a valve housing 12 and a gasket 14. Disposed within the housing 12 is the valve body 16 having a main portion 16*c*, an upstanding cylindrical wall 26 extending upward from the main portion 16*c*, and a lower portion 16*a* extending downward from the main portion 16*c*. The main portion 16*c* and the upstanding cylindrical wall 26 have an inner cylindrical surface 22*a* defining a recess 22. FIG. 4 is a sectional view of the valve body 16, showing the main portion 16*c*, the upstanding cylindrical wall 26, the lower portion 16*a* and the recess 22, A valve stem 20 is disposed within the recess 22 of the valve body 16. The valve body is biased toward the gasket 14 by a spring 18. The lower portion 16*a* of the valve body 16 is adapted to be engaged by the spring 18. For example, the spring 18 can engage an annular groove 90 as shown in FIGS. 1 and 4. The outer wall 16*b* of the main portion 16*c* of the valve body 16 is preferably inwardly tapered toward the lower portion 16*a* of the valve body 16 while the interior wall 12*a* of the valve housing 12 preferably flares outward at its top. This provides space allowing for the rotation of the valve body 16 during tilt activation, which is discussed further, below. A conventional dip tube 46 is shown attached to the bottom of the housing 12.

Figure 5:
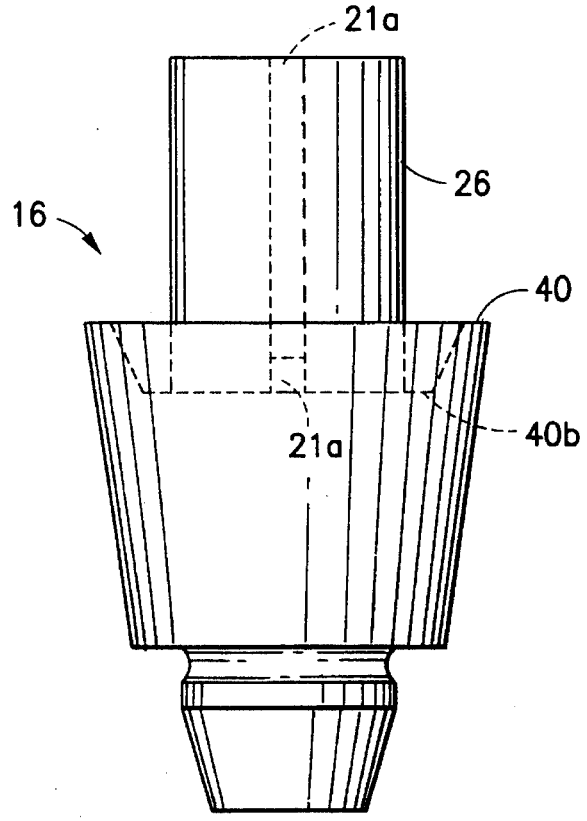
FIG. 5 is a side view of the valve body of the present invention.
Figure 6:
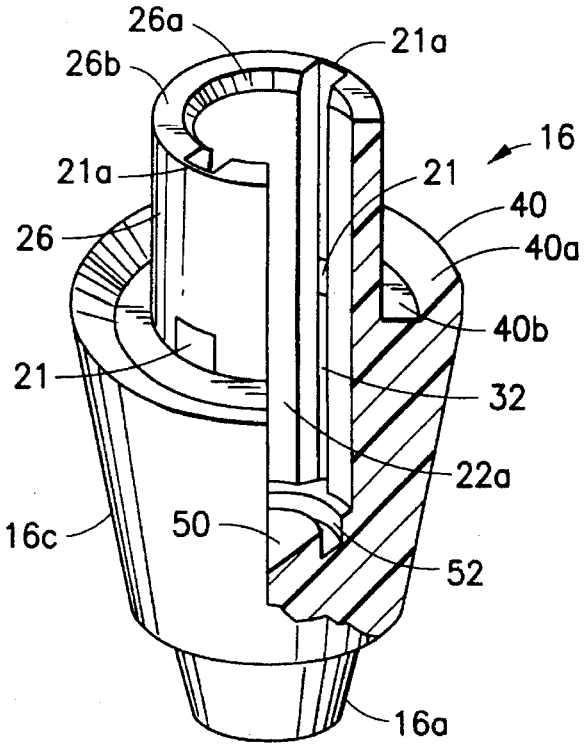
FIG. 6 is a perspective partial sectional view of the valve body of the FIGS. 4–5.
Figure 7:
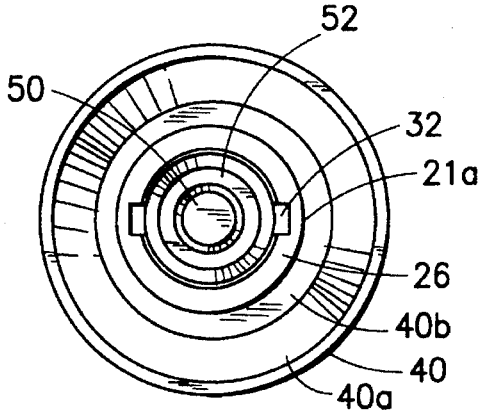
FIG. 7 is a view along line 7—7 of the valve body of FIG. 4.

Upstanding cylindrical wall 26, shown in FIGS. 5–6, defines the upper portion of the recess 22. The top inner edge 26*a* of the upstanding cylindrical wall is chamfered to ease insertion of the valve stem 20 into the valve body 16. The upstanding cylindrical wall 26 has a thin rectangular region 21*a* referred to as a region or thin skin. The location of the thin skin 21*a* is shown in phantom in FIG. 5. The cross-section of the thin skin 21*a* may be substantially uniform as shown in FIG. 4; its back portion is shown in FIG. 6. The thin skin 21*a* runs from the top shoulder 26*b* of the cylindrical wall 26, almost to its bottom. Beneath the thin skin 21*a* is a slot 21 passing through the cylindrical wall 26. The slot 21 is defined by the thin skin 21*a* and the cylindrical wall 26. The slot 21 is shown in phantom in FIG. 5. See also FIGS. 4 and 6. Preferably, there is a second thin skin 21*a* and slot 21 on the opposite side of the cylindrical wall 26. See FIG. 6. More than two slots is not preferred because it can weaken the cylindrical wall 26. These slots 21 allow for the passage of product into the valve body 16, as will be described below. Beneath the slots 21 are grooves 32 in the inner cylindrical surface 22*a* of the valve body 16, shown in FIGS. 4 and 6, for example. FIG. 7 is a top view of the valve body along line 7—7 of FIG. 4, with the cylindrical wall 26, thin skins 21*a* and groove 32 identified.

The upper portion of the tapered valve body ends in an annular shoulder 40 which engages the gasket 14 when the valve is closed, as shown in FIG. 1. This shoulder 40 is preferably rounded at its top, as shown in FIG. 4, to improve the seal with the gasket 14 when the valve is closed, as shown in FIG. 1. Depending from the shoulder 40 is a first annular wall 40*a*, preferably tapered toward the center of the valve body 16. The first annular wall 40*a* intersects a second annular wall 40*b* which is perpendicular to the upstanding cylindrical wall 26. See FIG. 7. The first and second annular walls 40*a*, 40*b*, and the cylindrical wall 26 form an annular recess 40*c* which directs product towards the slots 21, as described below.

Figure 8:
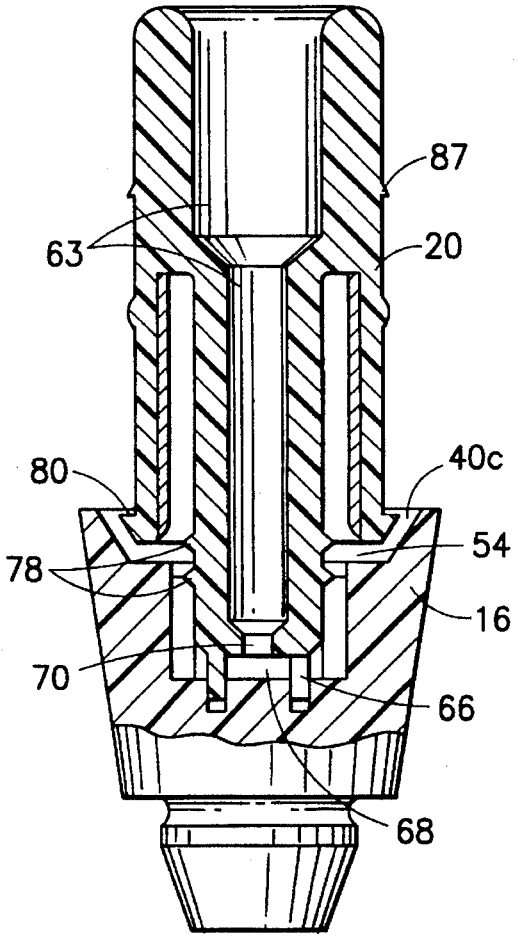
FIG. 8 is a partial sectional view of the valve body-valve stem assembly of the present invention.
Figure 9:
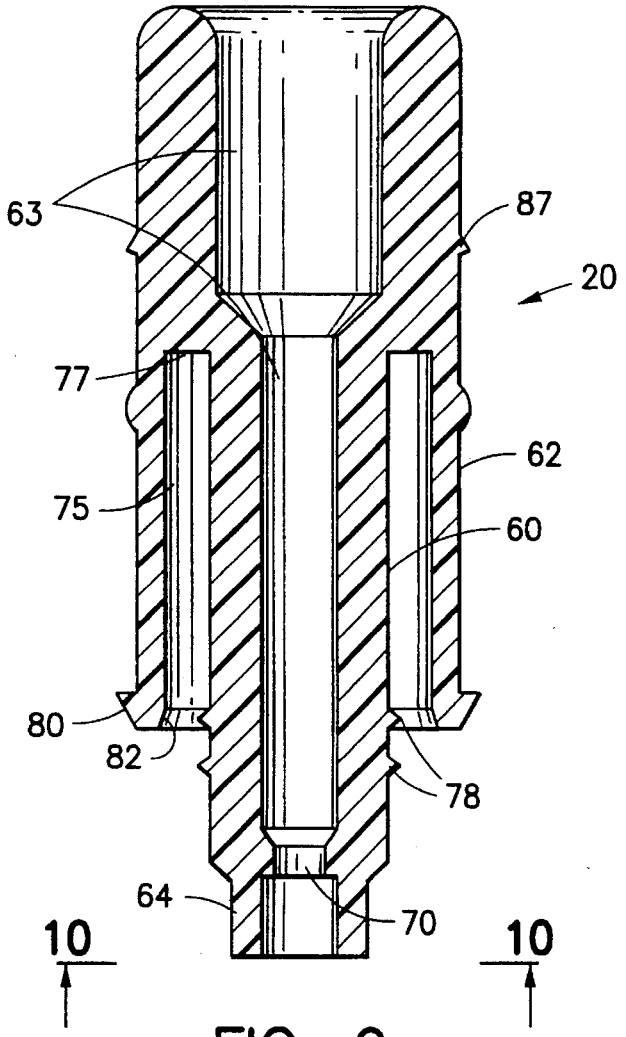
FIG. 9 is a longitudinal sectional view of the valve stem of the present invention.
Figure 10:
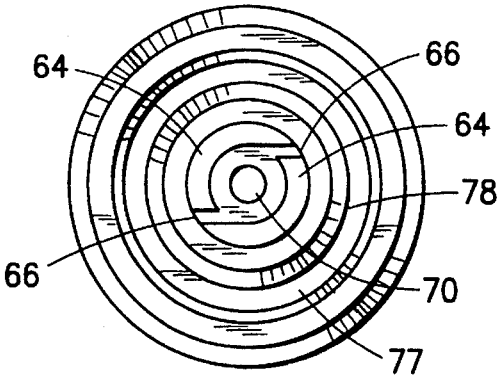
FIG. 10 is a view along line 10—10 in FIG. 9.
Figure 11:
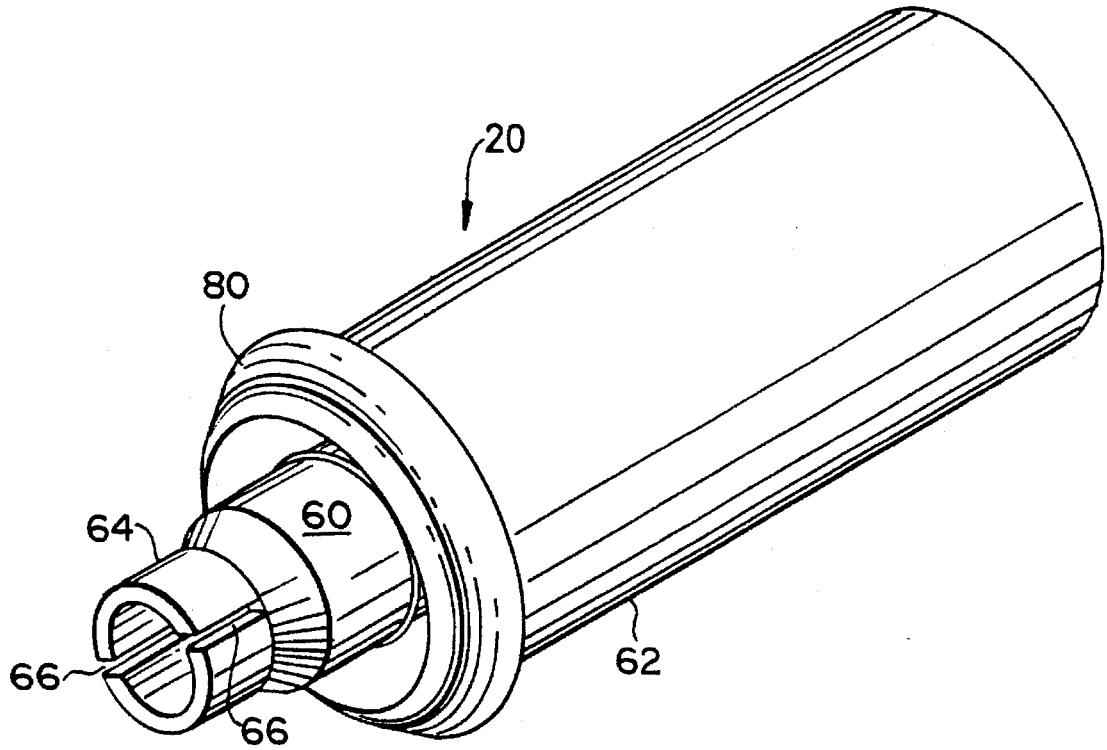
FIG. 11 is a perspective view of the valve stem of FIG. 9.

The valve stem 20 is disposed within the recess 22 of the valve body 16, as shown in FIGS. 1 and 8, for example. The valve stem 20, as shown in FIG. 9, includes an inner cylindrical portion 60 and an outer cylindrical portion 62. A longitudinal opening 63 passes through the valve stem 20. Preferably, a lower cylindrical portion 64 depends from the inner cylindrical portion 60. The lower cylindrical portion 64 of the valve stem 20 has oppositely positioned tangential openings 66. See FIG. 11. The cross-sectional views in FIGS. 1 and 8, for example, go through one of the tangential openings 66. FIG. 10 is a bottom view of the valve stem along line 10—10 of FIG. 9, showing the tangential openings 66 in the lower cylindrical portion 64.

The bottom of the recess 22 of the valve body 16 preferably includes a circumferential groove 52, as shown in FIGS. 4 and 6, for example. The lower cylindrical portion 64 of the valve stem is inserted into the circumferential groove 52, forming a swirl chamber 68. The fit between the lower cylindrical portion 64 and circumferential groove 52 forms a tight seal between the valve body 16 and the valve stem 20. Therefore, product can only enter the swirl chamber 68 through the tangential openings 66. The portion of the bottom of the recess 22 of the valve body 16 within the circumferential groove 52 forms the bottom 50 of the swirl chamber 68. The use of a swirl chamber is preferred for enhanced spray characteristics, particularly with compressed gas propellant, as is described further below. The tangential openings may be about 6 thousandths of an inch wide and 10 thousandths of an inch high. These dimensions may be varied dependent on the product and propellant.

Figure 12:
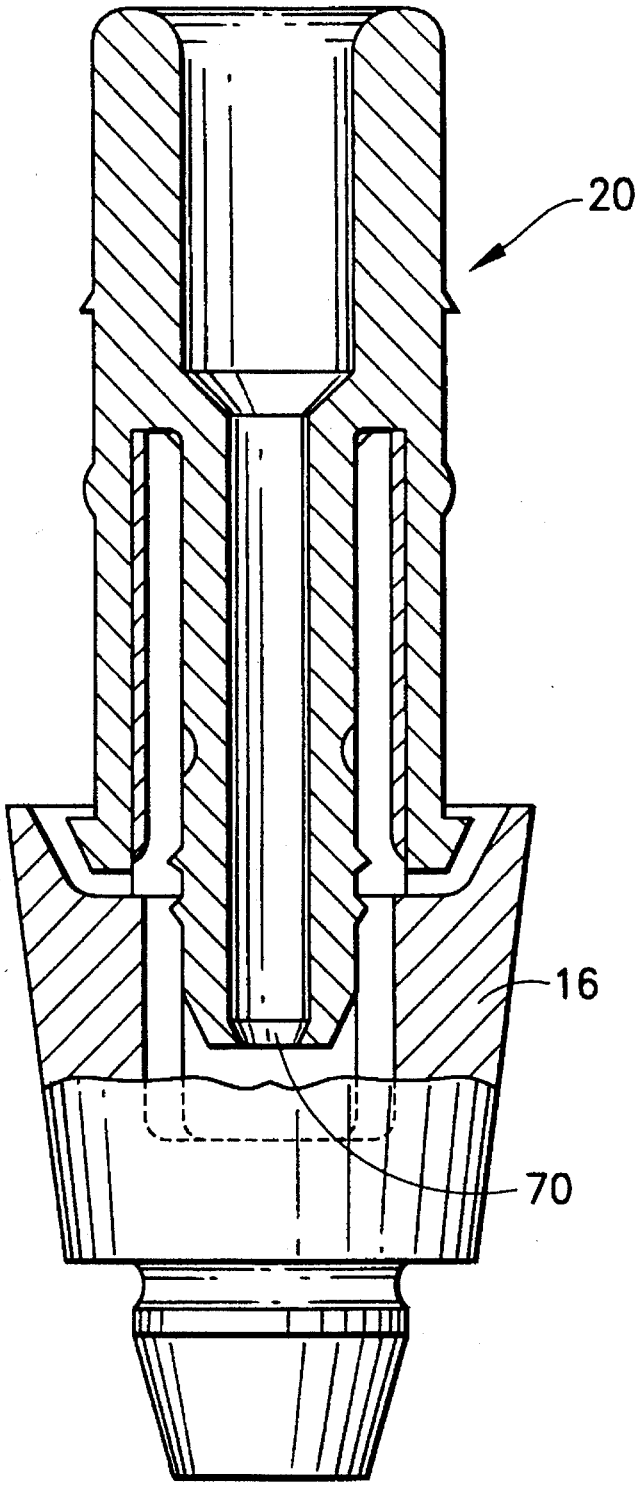
FIG. 12 is a longitudinal sectional view of another embodiment of the valve body-valve stem assembly of the present invention.

FIG. 12 shows another embodiment of the present invention, without the swirl chamber. The valve body 16 is the same except there is no groove 52. The valve stem 20 is the same except there is no lower cylindrical portion 64.

Returning to FIG. 8, the valve stem 20 has an orifice 70 above the swirl chamber 68 which, in the preferred embodiment of the invention, acts as a product flow control orifice. Disposing the orifice 70 above the swirl chamber permits product in the valve stem on the discharge side of orifice 70 to back flow into the swirl chamber and thus product is less likely to clog the product passage in the valve stem. Still further, disposing the orifice 70 on the discharge side of the swirl chamber 68 can also create a residue of propellant in the swirl chamber upon closing of the aerosol valve, which residue will assist in purging the valve stem and actuator product passages of residual product to thereby avoid or reduce clogging. The orifice may have a diameter of 13 thousandths of an inch, which can be varied dependent on the product and propellant used.

In the embodiment shown in FIG. 12, product entering the bottom of the recess 22 of the valve body 16 will enter the valve stem 20 directly through the orifice 70.

Preferably, the recess 22 of the valve body 16 includes an annular protrusion 54. Similarly preferred are a pair of annular protrusions 78 on the valve stem 20 for engaging the annular protrusion 54 of the valve body 16, securing the assembled valve body-valve stem together, as shown in FIG. 8.

The outer cylindrical portion 62 of the valve stem 20 preferably includes an annular flange 80. The flange prevents excessive displacement of the gasket during actuation. The shape of the annular recess 40*c* generally conforms to the shape of the flange 80. A recess 75 is formed between the inner and outer cylindrical portions 60, 62 of the valve stem 20. The recess has an annular shoulder 77 which connects the inner and outer cylindrical portions 60, 62, and against which the upstanding cylindrical wall 26 bottoms when the valve body 16 and valve stem 20 are in assembled relation. The inner edge 82 of the outer cylindrical portion 62 of the valve stem 20 is tapered to ease insertion into the valve body 26.

Figure 3:
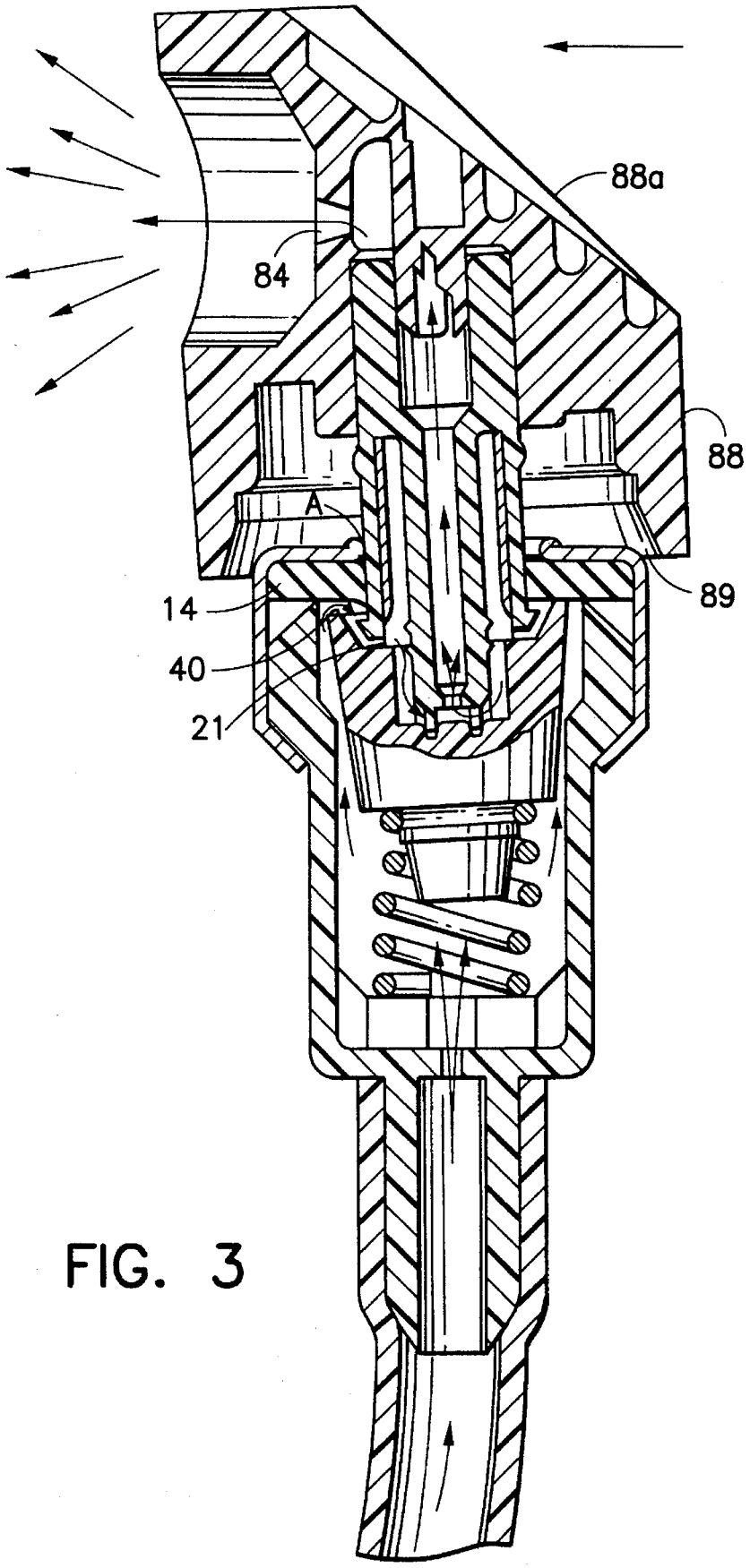
FIG. 3 is a longitudinal sectional view of the valve of FIG. 1, opened by tilt activation.

An actuator button 85 is mounted on the upper portion of the valve stem 20, as shown in FIG. 1. An annular rib or barb 87 is formed on the valve stem 20, which rib 87 anchors the valve stem 20 to the actuator button and facilitates removal of the valve stem 20 from the valve body 16. A tilt button 88 with an inclined surface 88*a* may also be provided for tilt actuation, as shown in FIG. 3. The inclined surface 88*a* eases engagement and continued actuation in the tilt position during prolonged use. A recess 89 may be provided at the bottom of the tilt button 88 so that the bottom of the button will not interfere with the pedestal of the mounting cup 10 during use.

In the closed position of the aerosol valve, shown in FIG. 1, the gasket 14 seals against the annular top shoulder 40 of the valve body 16 and the upstanding cylindrical wall 26 of the valve body 16 to prevent passage of product through the slot 21.

Figure 2:
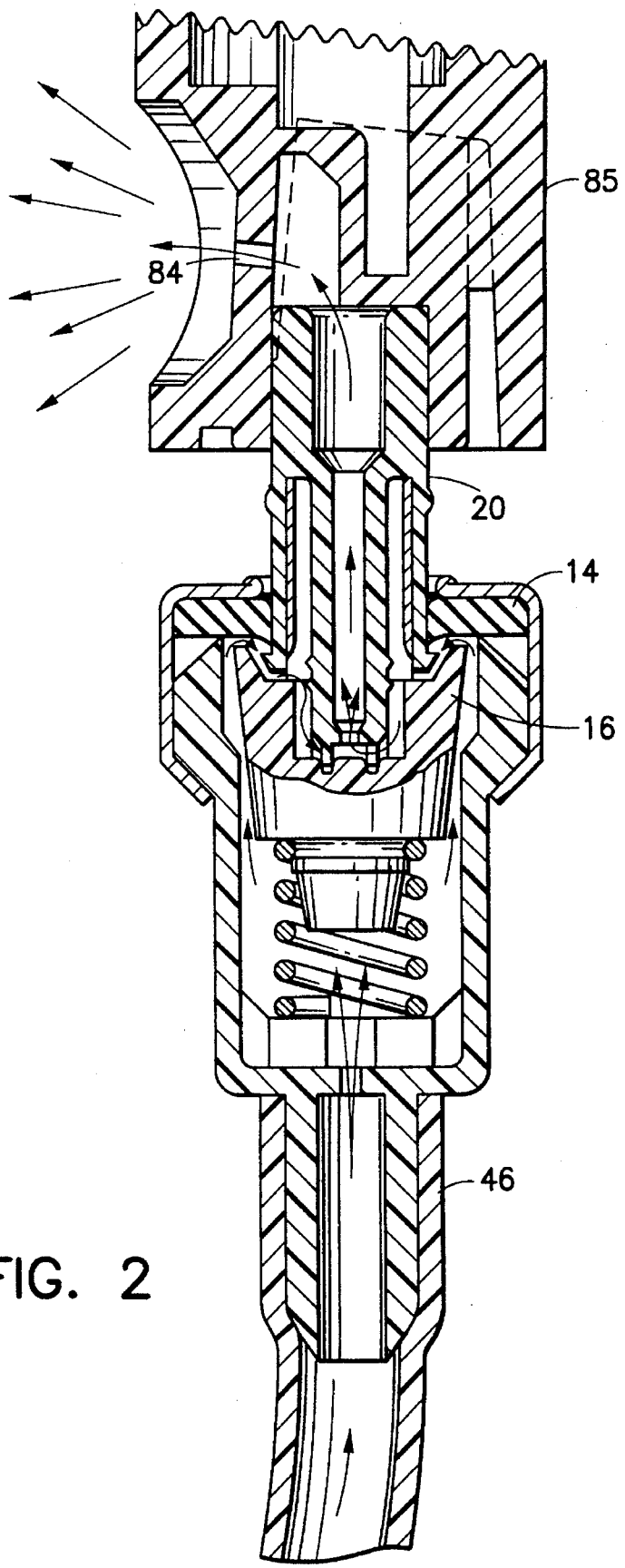
FIG. 2 is a longitudinal sectional view of the valve of FIG. 1 in an open position.

In the open position of the valve, shown in FIG. 2, vertical pressure on the actuator button 85 depresses the valve stem 20 and the valve body 16, disengaging the annular shoulder 40 from the gasket 14. The pressurized contents of the container can then pass over the shoulder 40, into the annular recess 40*c* and through the slots 21. The product proceeds down the grooves 32, through the tangential openings 66 in the lower cylindrical portion 64, into the swirl chamber 68. The product proceeds out of the swirl chamber 68, through the orifice 70, up the valve stem to the discharge orifice 84 of the actuator button 85.

The tangential entrances 66 of the swirl chamber 68 impart a circular motion to the discharging product, and force the two product streams into each other. This causes a mechanical breakup of the product. Particles within the product stream are broken up and dissolved and the product stream is energized. This provides for a finer, drier spray. The use of a swirl chamber is preferred to enhance spray characteristics, particularly if the propellant used is compressed gas. It is believed that satisfactory spray characteristics can be maintained with a compressed gas propellant as the product is dispensed in periodic use, without the use of vapor taps. Vapor taps can use up the available propellant before the product is fully dispensed.

Operation as a tilt action valve is shown in FIG. 3. To actuate the valve, the tilt button 88 is depressed forward and downward. This disengages the front portion of the shoulder 40 from the gasket 14, as the valve body-valve stem rotates forward. Product passes over the shoulder 40, through slot 21 to be discharged, as described above with respect to FIG. 2. The tapered shape of the valve body 16 and the flared interior wall 12*a* of the valve housing provides space for the rotational movement of the valve body 16 during tilt actuation.

The container can be packaged as either a conventional or tilt action container. An extra button can be included in the packaging to provide for alternative use. The buttons can be easily changed.

It has been found that in tilt actuation, a portion of the valve stem may engage the pedestal of the mounting cup. See region "A" in FIG. 3. Excessive pressure exerted on the button 88 could be transferred through the valve stem 20 to the valve body 16. If the slot 21 runs from the top of the cylindrical wall 26, as in U.S. Pat. No. 5,027,985, this force could separate the wall, loosening the valve stem. Therefore, the design of the '985 patent is not suitable for tilt actuation. The thin skin 21*a* is added in the present invention to reinforce the cylindrical wall in this region to maintain the tight fit between the valve stem and valve body. Such reinforcement allows for more reliable molding, as well.

The use of the thin skin enables molding of the valve body without the use of "side action" pins. The core pin used in molding the valve body 16 has a pair of extended sections on opposite sides, which decreases the distance between the core pin and the mold cavity. Plastic filling in this region forms the thin skin 21*a*. Even greater extensions lie beneath the extended sections. These extensions contact the outer wall of the mold cavity, preventing the collection of plastic. The slots are formed in these regions. The thin skin is pliable enough after molding to allow for easy removal of the core pin. Therefore, no "side action" pins are required to form the slots 21. As discussed above in the Background of the Invention, "side action" pins can slow the molding process.

The skin is preferably about 4 thousandths of an inch thick, which allows for easy removal of the core pin and provides sufficient reinforcement during tilt actuation. The cylindrical wall 26 is approximately 20 thousandths of an inch thick. The slot 21 may be 0.020 inches×0.020 inches.

In assembling the several valve components, a sub-assembly comprising the valve stem, valve body, spring and gasket is initially made. Such a sub-assembly properly orients and maintains the position of the gasket relative to the valve body, thereby enabling rapid assembly of the sub-assembly and other valve components without risk of dislodging the orientation of the gasket to the other components prior to permanent positioning of the gasket through crimping of the valve to the mounting cup.

The structure in the valve stem-valve body fitment portions that facilitates disposition and positional stabilization of the gasket onto the valve body is best shown in FIG. 8. In assembling the valve unit the gasket 14 is passed over the outside surface of valve stem 20 and ultimately seated on the annular shoulder 40 of the valve body 16.

Moreover, the height of the cylindrical wall 26 is preferably greater than the gasket thickness, to prevent the top shoulder of the cylindrical wall 26 from passing beneath the gasket 14 during pressure filling of the container with propellant.

I claim:

1. An aerosol valve unit comprising a mounting cup, a gasket having a central opening, a valve housing, a valve stem and a valve body, wherein the valve stem and valve body move within the valve housing in response to forces exerted on the valve stem, wherein the valve body has a recess defined by a main body portion and a radially inward upstanding wall portion extending from the main body portion, said main body portion having an upper annular shoulder for sealing against the gasket, said upstanding wall portion having a continuous outer wall and an interior surface with at least one thin region disposed longitudinally and radially inward of the continuous outer wall, which thin region extends from the top shoulder of the upstanding wall portion to the base of the upstanding wall and terminates in a slot in the upstanding wall portion, the slot communicating with the interior of the container when the valve is actuated;

wherein the valve stem comprises an outer wall portion that frictionally and releasably engages the upstanding wall portion of the valve body and extends into the valve body recess below the gasket, the valve stem having an opening through its longitudinal axis and an orifice at the base of the longitudinal opening, which orifice communicates on one side with the slot in the recess of the valve body and communicates at its other side with the longitudinal opening in the valve stem; and wherein the gasket seals the slot when the valve is in a closed position.

2. The aerosol valve unit of claim 1, wherein the thin region is located proximate the outside diameter of the upstanding wall portion.

3. The aerosol valve unit of claim 1, wherein the thin region has a substantially uniform thickness.

4. The aerosol valve unit of claim 1, wherein the terminal shoulder of the upstanding wall portion has a chamfer to ease insertion of the valve stem into the valve body.

5. The aerosol valve unit of claim 1, wherein the valve stem has a radially extending annular flange on its lower end.

6. The aerosol valve unit of claim 5, wherein the annular flange generally conforms in shape to the annular recess in the valve body to define, in part, a flow path to the slot in the valve body.

7. The aerosol valve unit of claim 1, wherein the surface of the recess in the valve body has at least one annular protrusion and the outer surface of the valve stem to be positioned within the valve body has at least one annular notch to receive the annular protrusion of the valve body and thereby positionally interlock the valve body and valve stem.

8. The aerosol valve unit of claim 1, wherein the annular shoulder portion, which seals against the gasket when the valve is not actuated, is disposed so as to be at least partially disengaged from the gasket by vertical or tilt actuation of an actuator button, thereby allowing product to pass over the portion of the shoulder of the main part of the valve body disengaged from the gasket, and subsequently through the valve body recess and valve stem opening to discharge.

9. The aerosol valve unit of claim 1, wherein a groove in the interior wall of the main body portion extends downward from the slot in the upstanding wall portion and communicates the slot in the upstanding wall portion and the orifice in the valve stem.

10. The aerosol valve unit of claim 1, wherein the valve stem extends into a recess in the bottom surface of the main body portion and the orifice in the valve stem is disposed contiguous to and above the bottom surface of the main body portion.

11. The aerosol valve unit of claim 1, and further wherein the main body portion is tapered inwardly toward its lower end and wherein the valve housing has an upper inner diameter and a lower inner diameter, the upper inner diameter being greater than the lower inner diameter.

12. The aerosol valve unit of claim 11, wherein the thin region is located proximate the outside diameter of the upstanding wall portion.

13. The aerosol valve unit of claim 11, wherein the thin region has a substantially uniform thickness.

14. The aerosol valve unit of claim 11, wherein the terminal shoulder of the upstanding wall portion has a chamfer to ease insertion of the valve stem into the valve body.

15. The aerosol valve unit of claim 11, wherein the valve stem has a radially extending annular flange on its lower end.

16. The aerosol valve unit of claim 15, wherein the annular flange generally conforms in shape to the annular recess in the valve body to define, in part, a flow path to the slot in the valve body.

17. The aerosol valve unit of claim 11, wherein the surface of the recess in the valve body has at least one annular protrusion and the outer surface of the valve stem to be positioned within the valve body has at least one annular notch to receive the annular protrusion of the valve body and thereby positionally interlock the valve body and valve stem.

18. The aerosol valve unit of claim 11, wherein the annular shoulder portion, which seals against the gasket when the valve is not actuated, is disposed so as to be at least partially disengaged from the gasket by vertical or tilt actuation of an actuator button, thereby allowing product to pass over the portion of the shoulder of the main part of the valve body disengaged from the gasket, and subsequently through the valve body recess and valve stem opening to discharge.

19. The aerosol valve unit of claim 11, wherein a groove in the interior wall of the main body portion extends downward from the slot in the upstanding wall portion and communicates the slot in the upstanding wall portion and the orifice in the valve stem.

20. The aerosol valve unit of claim 1, wherein the valve stem extends into a recess in the bottom surface of the main body portion and the orifice in the valve stem is disposed contiguous to and above the bottom surface of the main body portion.

21. The aerosol valve unit of claim 1, wherein the valve stem has an inner wall portion interior of and paralleling a portion of the wall portion that frictionally and releasably engages the upstanding wall portion of the valve body, which inner wall portion terminates in a portion that is adapted to be received at the bottom of the recess in the valve body, the longitudinal opening in the valve stem extending through the inner wall portion and said opening communicating at the end of the inner wall portion positioned within the valve body recess with a tangentially fed swirl chamber.

22. The aerosol valve unit of claim 11, wherein the valve stem has an inner wall portion interior of and paralleling a portion of the wall portion that frictionally and releasably engages the upstanding wall portion of the valve body, which inner wall portion terminates in a portion that is adapted to be received at the bottom of the recess in the valve body, the longitudinal opening in the valve stem extending through the inner wall portion and said opening communicating at the end of the inner wall portion positioned within the valve body recess with a tangentially fed swirl chamber.

23. The aerosol valve unit of claim 22, wherein the swirl chamber has a multiple tangential feed.

24. The aerosol valve unit of claim 21, wherein a groove in the interior wall of the main body portion extends downward from the slot in the upstanding wall portion and communicates the slot in the upstanding wall portion and the orifice in the valve stem.

25. The aerosol valve unit of claim 22, wherein a groove in the interior wall of the main body portion extends downward from the slot in the upstanding wall portion and communicates the slot in the upstanding wall portion and the orifice in the valve stem.

26. The aerosol valve unit of claim 23, wherein a groove in the interior wall of the main body portion extends downward from the slot in the upstanding wall portion and communicates the slot in the upstanding wall portion and the orifice in the valve stem.

27. The aerosol valve unit of claim 21, wherein the valve stem extends into a recess in the bottom surface of the main body portion and the orifice in the valve stem is disposed contiguous to and above the bottom surface of the main body portion.

28. The aerosol valve unit of claim 22, wherein the valve stem extends into a recess in the bottom surface of the main body portion and the orifice in the valve stem is disposed contiguous to and above the bottom surface of the main body portion.

29. The aerosol valve unit of claim 23, wherein the valve stem extends into a recess in the bottom surface of the main body portion and the orifice in the valve stem is disposed contiguous to and above the bottom surface of the main body portion.

* * * * *